US008511016B2

(12) United States Patent
Smythe, Jr.

(10) Patent No.: US 8,511,016 B2
(45) **Date of Patent: *Aug. 20, 2013**

(54) BOXABLE DRYWALL CORNER BEAD

(76) Inventor: Timothy D. Smythe, Jr., Bend, OR (US)

( * ) Notice: Subject to any disclaimer, the term of this patent is extended or adjusted under 35 U.S.C. 154(b) by 1714 days.

This patent is subject to a terminal disclaimer.

(21) Appl. No.: 11/221,386

(22) Filed: Sep. 7, 2005

(65) Prior Publication Data

US 2006/0059809 A1 Mar. 23, 2006

Related U.S. Application Data

(63) Continuation-in-part of application No. 10/924,267, filed on Aug. 23, 2004, now abandoned, which is a continuation of application No. 09/965,641, filed on Sep. 27, 2001, now Pat. No. 6,779,313, which is a continuation-in-part of application No. 09/608,084, filed on Jun. 30, 2000, now abandoned.

(51) Int. Cl.
*E04B 1/00* (2006.01)
*E04B 2/00* (2006.01)
*E04C 2/38* (2006.01)

(52) U.S. Cl.
USPC ..... 52/255; 52/287.1; 52/656.1

(58) Field of Classification Search
USPC ..... 52/254, 255, 656.1, 287.1
See application file for complete search history.

(56) References Cited

U.S. PATENT DOCUMENTS

| | | | | |
|---|---|---|---|---|
| 2,643,423 | A * | 6/1953 | Brendel | 52/255 |
| 2,851,741 | A * | 9/1958 | Stemples | 52/255 |
| 2,904,856 | A | 9/1959 | Robinson | 52/255 |
| 3,090,087 | A | 5/1963 | Miller | 52/287.1 |
| 3,255,561 | A | 6/1966 | Cable | 52/255 |
| 4,313,991 | A | 2/1982 | Lamb | 428/131 |
| 4,863,774 | A * | 9/1989 | Tucker | 428/77 |
| 5,131,198 | A | 7/1992 | Richie et al. | 52/287.1 |
| 5,428,929 | A * | 7/1995 | Reese | 52/255 |
| 5,778,617 | A * | 7/1998 | Free | 52/255 |
| 5,904,016 | A | 5/1999 | Koenig et al. | 52/255 |
| 6,073,406 | A | 6/2000 | Kearney | 52/287.1 |
| 6,119,420 | A | 9/2000 | Koenig, Jr. et al. | 52/255 |
| 6,148,573 | A | 11/2000 | Smythe, Jr. | 52/255 |
| 6,212,836 | B1 | 4/2001 | Larson | 52/287.1 |
| 6,295,776 | B1 | 10/2001 | Kunz et al. | 52/255 |
| 6,779,313 | B2 | 8/2004 | Smythe, Jr. | 52/255 |

* cited by examiner

*Primary Examiner* — Joshua J Michener
*Assistant Examiner* — Elizabeth A Plummer
(74) *Attorney, Agent, or Firm* — Clifford Kraft

(57) ABSTRACT

A boxable corner bead for finishing drywall corners that is made from two flanges with a protruding nose section. This bead can be made in regular, bullnose, or flex trim type arrangements. Once the bead is attached to a drywall corner, it can be mudded on both sides of the corner without waiting for the mud on the first side to dry. This is because of the shape of the nose which allows a mud dispensing box to apply mud on one side without getting mud on the nose. The box can then be immediately moved to the other side, where that side can be mudded. The nose itself is prepared to directly receive paint or texture, and hence does not need any mud. A version of the device has a raised trapezoidal, triangular or bull-nose section with a V-groove cut in the back. The bead hinges around the V-groove to match any corner angle. Both sides can be mudded as with the fixed bead. The beads can be used with both interior and exterior corners.

4 Claims, 7 Drawing Sheets

BOXABLE DRYWALL CORNER BEAD

This is a continuation-in-part of application Ser. No. 10/924,267 filed Aug. 23, 2004 which was a continuation of Ser. No. 09/965,641 filed Sep. 27, 2001, now abandoned, which was a continuation-in-part of application Ser. No. 09/608,084 filed Jun. 30, 2000, now abandoned.

BACKGROUND

1. Field of the Invention

This invention relates generally to the field drywall construction and more particularly to a drywall corner bead that can be finished on both sides wet with a standard mud dispensing box typical in the trade.

2. Description of the Related Art

For years in the drywall trade, automatic taping tool companies have tried to come up with a tool to box corners in one step. Boxing a corner means putting drywall mud on both sides of it in a condition that can later be sanded and painted. The problem with boxing traditional corners is that only one side at a time can be tooled. If an attempt is made to tool both sides of a corner at the same time, either the guide on the mud dispensing box will disturb (and ruin) the mud on the other side of the corner, or the mud coming out of the box will flow onto the other side. In either case, the corner would be left in an unacceptable condition. This has forced tooling or boxing only one side of each corner at a time. One side is tooled, then the mud must be allowed to dry, a process that requires coming back at least a day later. Only after the mud on the first side is totally dry, can the second side be tooled. Workers must typically pass through a construction site tooling only first sides of corners. They must then come back on a subsequent day to tool the second sides. This puts at least an extra day into the construction cycle.

What is badly needed it a corner bead that will allow a standard mud dispensing box to tool both sides of a corner while the mud is still wet. This corner should be available in standard or bullnose (rounded) styles for exterior corners, and should be a available as a flex-trim for interior corners. The worker should be able to mud one side and immediately mud the other.

SUMMARY OF THE INVENTION

The present invention relates to a drywall corner bead that can be mudded on both sides while the mud is still wet. At the apex of the bead, there is a flat finished surface that is prepared to receive paint or texture. This apex is shaped so that a standard mud dispensing box can deposit mud down one side without the mud running up entirely to the apex. Thus a finished side can be mudded without any mud on the apex. This then allows the box to mud the second side without any interference to the first side.

The bead resembles a standard corner bead with two flanges. The flanges can be flat or can taper or be beveled. The flanges can be nailed, glued, or mudded onto the wallboard. At the apex is the finished surface that never needs mud. The surface of the apex can be finished in any way that will allow it to take paint or texture. It can be roughed slightly, or it can be coated by a material to which paint or texture will adhere. The bead can be made from any plastic, high impact plastic, metal, or any other rigid material.

In the process, the worker cuts the bead to length and attaches it to the corner by any method (nailing, gluing, or mudding), and then muds the first side with a standard box. At typical box is seven inches. Immediately after mud is applied to the first side, the worker can move to the second side and mud it in an identical manner. The corner is thus totally mudded in minutes without any drying wait period. The boxable bead can be supplied in regular or bullnose styles for exterior corners, and interior trim or flex-trim for interior corners. It can come in standard lengths, or for trim, optionally in rolls.

The shape of the apex or nose on both the exterior and interior beads is the key to the ability of the present invention to function and totally distinguishes the present invention from the prior art. This unique shape allows the mud box to dispense mud on one side without the mud slopping over to the other side. This shape also allows a special two-part mud box to be designed that can dispense mud on both sides simultaneously.

Prior art corner beads with any shape of nose would allow mud to slop over when being applied to one side. In all prior art systems, mud must be applied to one side and then allowed to dry before new wet mud can be applied to the other side.

The special shape feature of all the apexes of the present invention is a wide flat area coming off the tip followed by a quick drop-off into the region designed to be mudded on each side. This flat area appears on a pointed apex for a sharp corner, a bullnose apex for a rounded corner or a sharp interior corner. Other shapes simply will not work.

On the exterior trim piece, an elongated protruding nose member is attached to a pair of flanges along the centerline on the room facing side. The protruding nose member has an elongated tip running parallel to the centerline end-to-end. The tip is formed by a pair of flat surfaces meeting at an angle where each of the surfaces is approximately parallel to one of the flanges respectively. The flat surfaces extend away from the elongated tip a predetermined distance to a taper point where they end, and the nose member quickly tapers into the flanges beyond the taper point. This way the elongated protruding nose member prevents wet mud applied to one of the flanges from crossing over to the other of the flanges. The actual tip can be pointed for a square corner or rounded (arcuate) for a bullnose corner.

On the interior trim piece, the flanges are initially laid out flat (unfolded). An elongated trapezoidal nose member is attached to the flanges along the centerline on the room facing side and runs parallel to the centerline. The nose member has a flat top also parallel to the flanges which extends away from the centerline for a predetermined distance to a taper point. Beyond the taper point, the flat top ends, and the nose member quickly tapers into the flanges. An elongated groove runs end-to-end along the centerline on the wall facing side of the flanges. The groove penetrates into the nose member forming a hinge that allows the flanges and the nose member to bend along the hinge to form an acute angle on the room facing side. The flat top on the nose member now forms two sections (after folding to match the wall angle), each section is still approximately parallel to one of the flanges. The sections form an acute angle on the room facing side such that the two sections on the nose member prevent wet mud applied to one of the flanges from crossing over to the other of the flanges.

BRIEF DESCRIPTION OF THE DRAWINGS

For a more complete understanding of this invention, reference should now be made to the embodiments illustrated in greater detail in the accompanying drawings and described below by way of examples of the invention.

Several drawings and illustrations have been presented to better aid in understanding the present invention. The scope of the present invention is not limited to what is shown in the figures.

DESCRIPTION OF THE INVENTION

Figure 1:
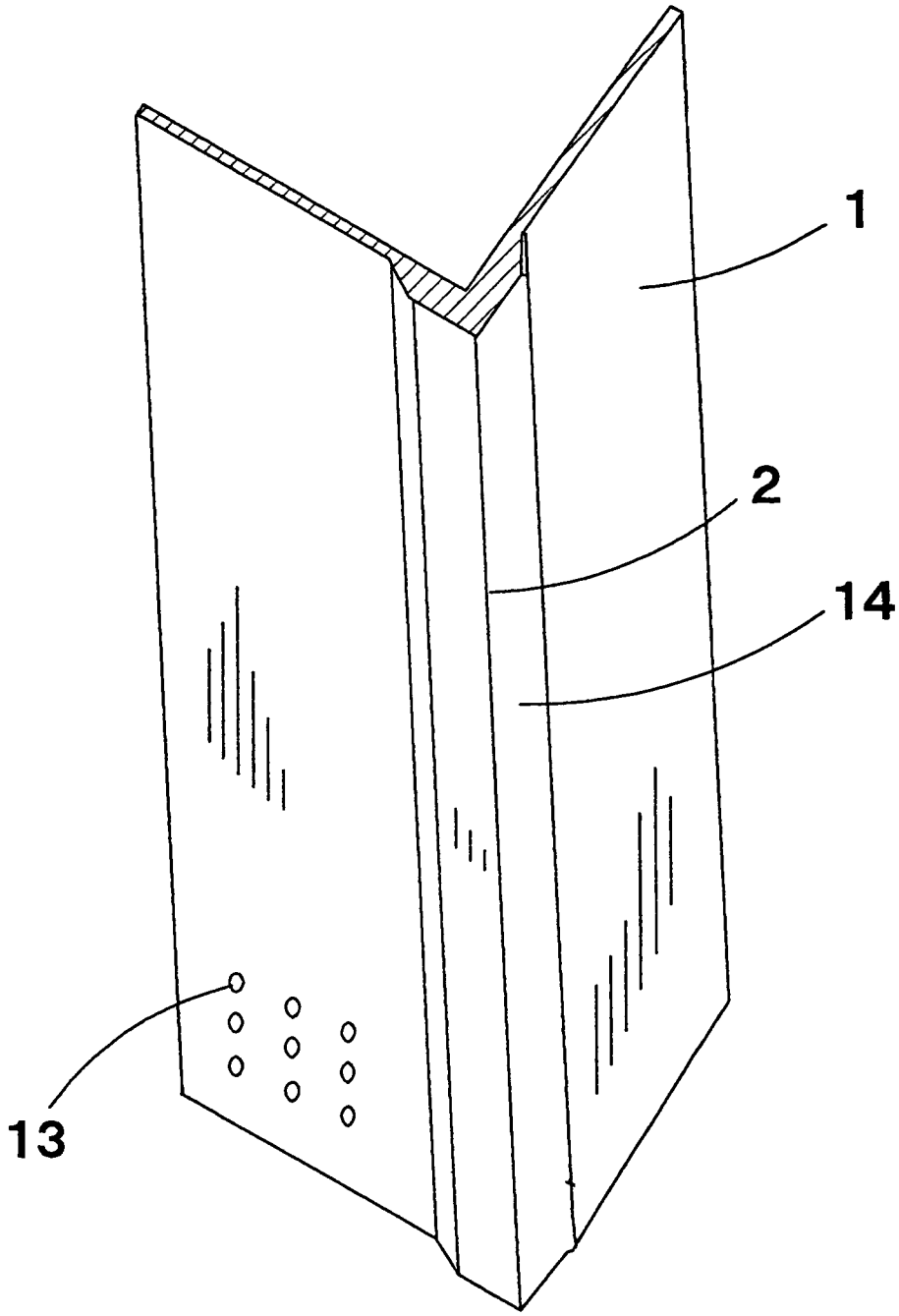
FIG. 1 shows a perspective view of the boxable bead with a standard style apex.

Turning to FIG. 1, a length of the boxable bead can be seen. This bead has flanges 1 like any conventional bead. However, it can be clearly seen that the nose 14 with apex 2 is different than a normal bead. This nose member 14 protrudes and runs end-to-end tapered into the flanges to allow a box to mud one side without interfering with the other. The style of corner shown in FIG. 1 is an exterior standard corner. It is also possible to construct the boxable bead of the present invention in bullnose or any other style. The nose 14 is finished or prepared to directly receive paint or texture. This preparation can be a slightly roughed surface, or a coating of any suitable material that paint or texture will adhere to. If the structure is a laminate containing an outer paper layer, the paper can be of a type that can directly receive paint or texture, or it can be prepared to receive paint or texture with a suitable coating. The entire surface of the bead could optionally be bonded with paper that can directly receive paint or texture.

The boxable bead of the present invention can be made of standard plastic, high impact polystyrene or other high impact plastic, metal, or any other rigid material. The preferred material is a high impact plastic. The structure can be a homogeneous piece, or it can be a laminate. While any type of laminate is within the scope of the present invention, preferred laminates are paper-plastic or paper-plastic-paper. The flanges 1 can optionally contain holes 13 to help the flange adhere to the drywall. It is also possible to rough the back side of the flanges or cause them to have ridges to make them adhere better. Holes, roughing, or ridges are used in the case when the bead is attached to the wallboard with mud rather than glue or nails. Attaching with mud is the preferred method.

Figure 2:
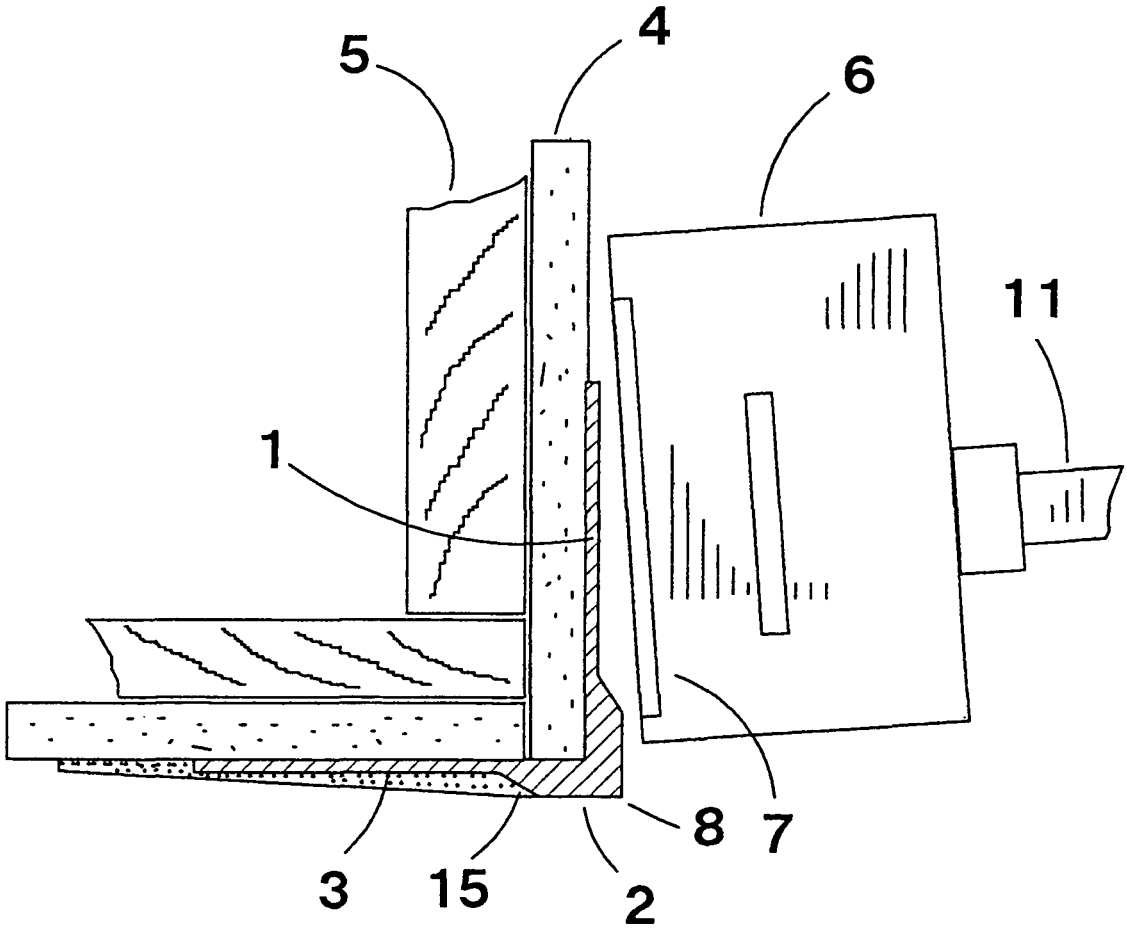
FIG. 2 shows a section of the corner and bead showing how the box is used to mud the bead.

FIG. 2 shows a section of wall, wallboard, and the boxable bead of the present invention installed on a 90 degree exterior corner. Drywall sheets 4 are nailed or screwed to wood 5 to form an exterior corner. The boxable corner is attached to the corner with a flange 1 on each side of the corner as normal beads are installed. The boxable bead can be nailed on, glued, or mudded in place, or attached to the corner by any other means. A mud dispensing box 6 with a slot 7 for dispensing mud is brought into contact with one side of the bead and wall as shown in FIG. 2. The box is held by a worker by means of a handle 11. The sides of the apex of the bead 2 hold the box at the correct angle for dispensing a smooth layer of mud. No mud is placed on the actual center of the corner 8. The corner shown in FIG. 2 is a standard corner. A layer of mud 3 is dispensed on the first corner, and immediately the box can begin mudding the second corner as shown in FIG. 2.

The unique structure of the protruding nose can be seen in FIG. 2. On each side of the tip 8 a flat region 2 extends away from the tip 8 to a taper point and a region 15 where the nose structure quickly and abruptly drops into the flange 1 creating a deep well that prevents mud from one flange from slopping over onto the other flange.

Figure 3:
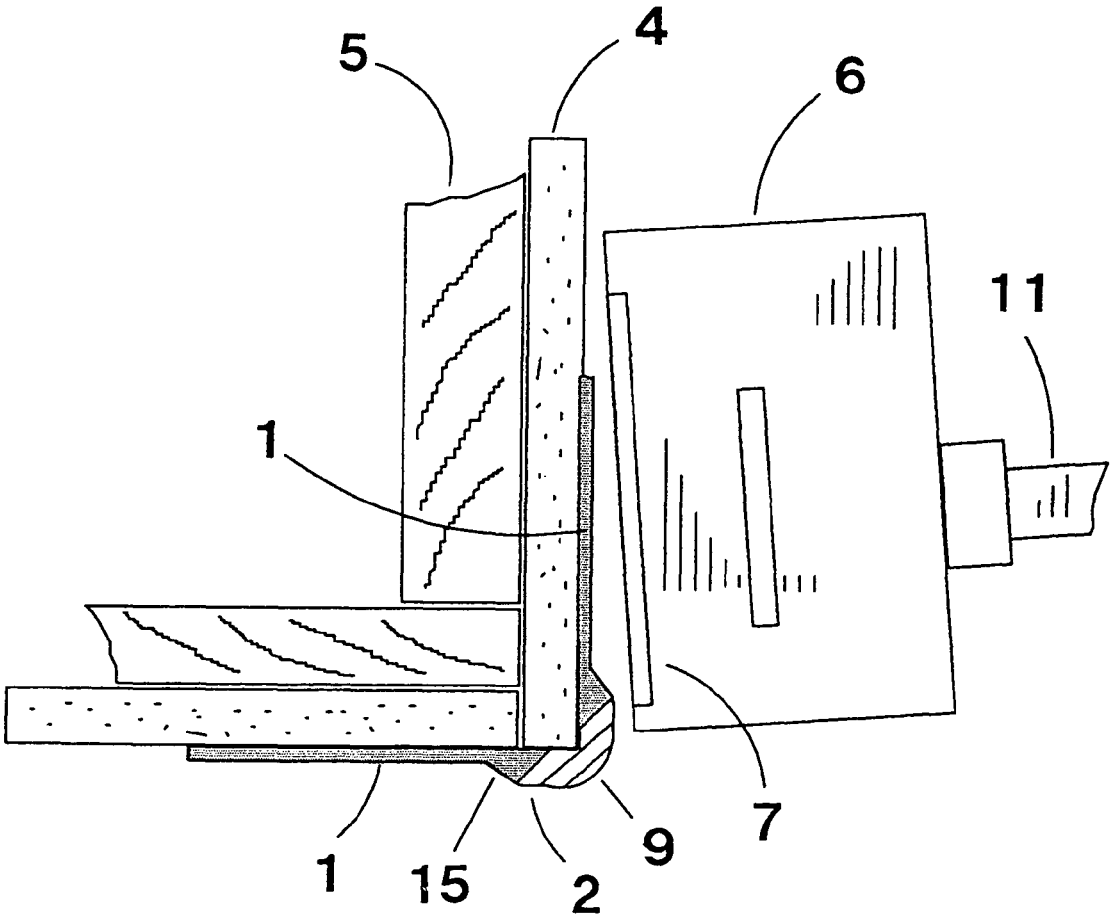
FIG. 3 is the same as FIG. 2, except the bead is bullnose.

FIG. 3 shows the same operation as FIG. 2 except the corner is bullnose 9. In FIG. 3, no mud has yet been applied, where in FIG. 2, mud 3 has been applied to one side of the bead. The bullnose apex 9 has a small flat region 2 which the box 6 touches during dispensing of mud. The actual apex 9 (and in FIG. 2 8) is prepared to directly receive paint and texture as previously described.

Again the unique structure of the protruding nose can be seen. In FIG. 3 there is a rounded tip 9 with a flat region 2 extending away from the tip 9. The flat region 2 is approximately parallel to the surface of the flange 1. At a taper point, a region is entered 15 where the structure quickly and abruptly drops into the flange 1 creating a well that prevents mud from one flange from slopping over onto the other flange during wet mudding of both sides of the structure.

Figure 4A:
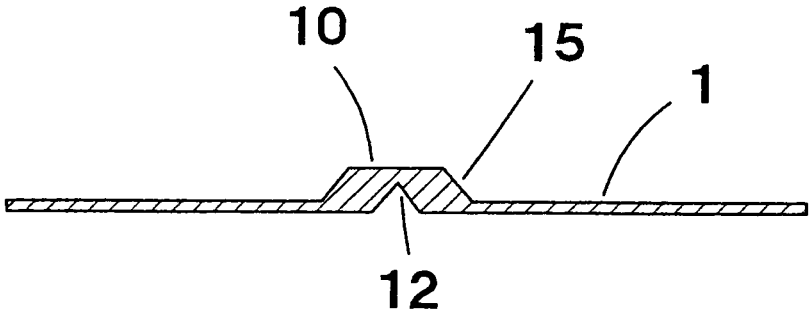
FIG. 4A shows the cross section of a trim type boxable bead for interior corners.

FIG. 4A shows the cross section of a flex embodiment of the present invention. This can be used on both interior and exterior corners. Again there is an elongated flat flange 1 with a notch or groove 12 on the back side. An apex 10 is shaped to form a perfect corner when a box applies mud. This is done by causing it to be a raised trapezoid section with a long side and a short side. A V-groove 12 is cut in the long side. The piece hinges on the V-groove 12 to match any corner angle. For an interior corner, a flat box may be used to mud the corner.

The structure of the trapezoidal nose can be clearly seen in FIG. 4A. In the unfolded configuration, the top of the trapezoid 10 is flat and parallel to the flange 1. At a taper point, a region of the nose structure is reached 15 that quickly and abruptly drops to the flange surface 1.

Figure 4B:
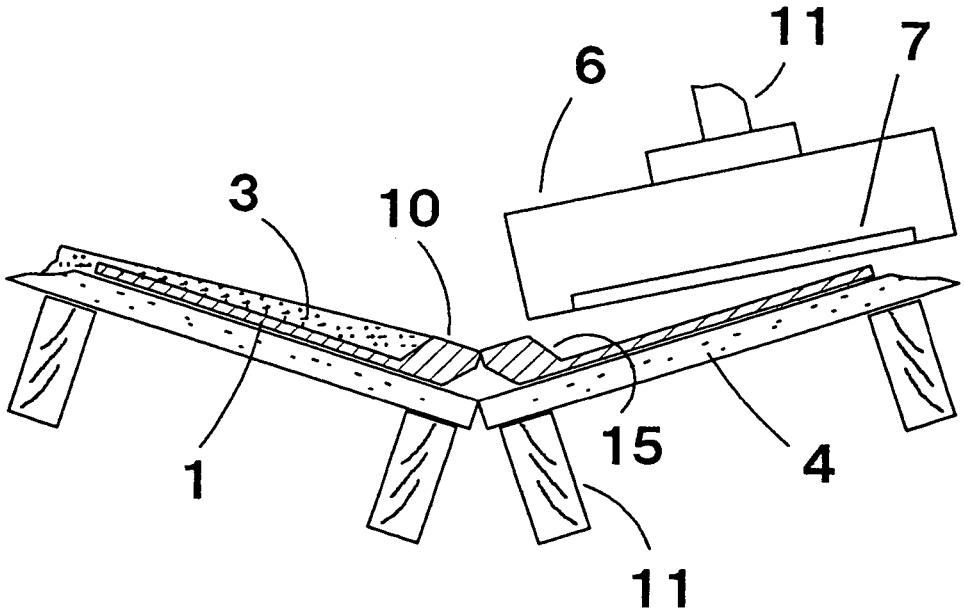
FIG. 4B shows a section of wall and corner for an interior corner that is not 90 degrees using a flex type of boxable bead.

FIG. 4B shows the trim piece of FIG. 4A installed on a non-ninety degree interior corner. Studs 11 have sheets of wallboard 4 nailed or screwed in place. The flanges 1 of the corner of FIG. 4A is attached to the wallboard 4 by nailing, gluing, mudding, or by any attachment method. The flex piece opens along the slot or V-groove 12 to match the angle of the corner. It is possible to match any interior or exterior angle with a single designed piece. A flat mud box 6 with a mud dispensing slot 7 and a handle 11 is again used to mud first one side of the corner 3 and then the second side. Again the apex 10 of the corner is finished and prepared to directly receive paint or texture as previous described.

Here in the folded configuration, the flat top 10 of the trapezoid divides into two parts each still parallel with the flange surface 1. Again, after a taper point, the structure drops abruptly 15 to the flange surface 1. This creates a steep wall that prevents mud from one flange from slopping over to the other side.

The present invention saves considerable time in the drywall finishing process by allowing a worker to cut a corner to length, attach it, and then box first one side and then immediately box the other side. As soon as the wall is dry, it can be sanded and a possible finish coat of mud can be put on both sides to make up for shrinkage. In any case, it is never necessary to wait for the first side to dry before beginning to apply mud with a box to the second side. It is possible to apply mud (box) both sides at the same time with a properly designed double box.

Figure 5:
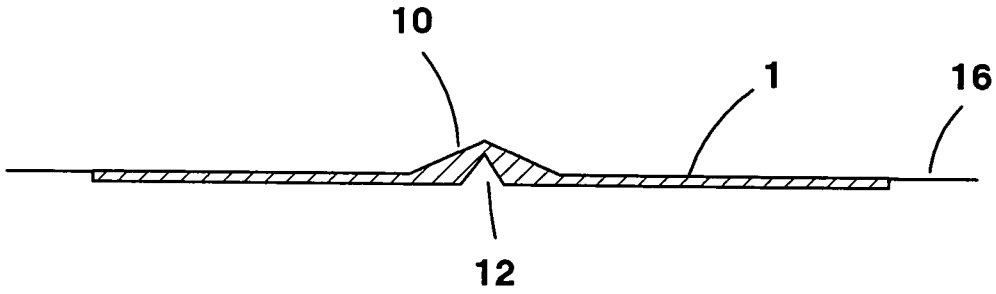
FIG. 5 shows a triangular embodiment of the present invention with extended flanges.
Figure 6:
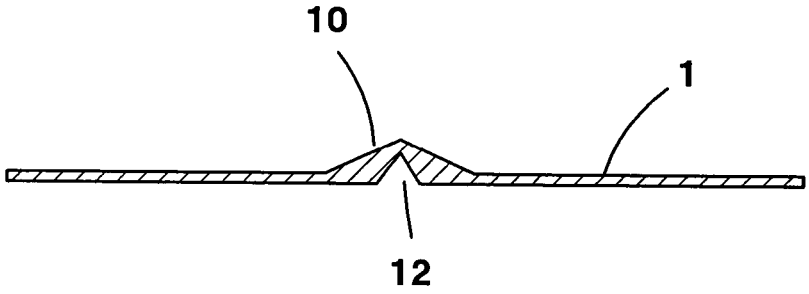
FIG. 6 shows the embodiment of FIG. 5 without extended flanges.

FIG. 5 and FIG. 6 show an embodiment of the present invention with a triangular nose piece 10. The V-groove 12 is similar to the embodiment shown in FIG. 4A. FIG. 5 shows a version with an extended flange 16, preferably paper (however any material is within the scope of the present invention). FIG. 6 shows the same embodiment without the extended flange.

Figure 7:
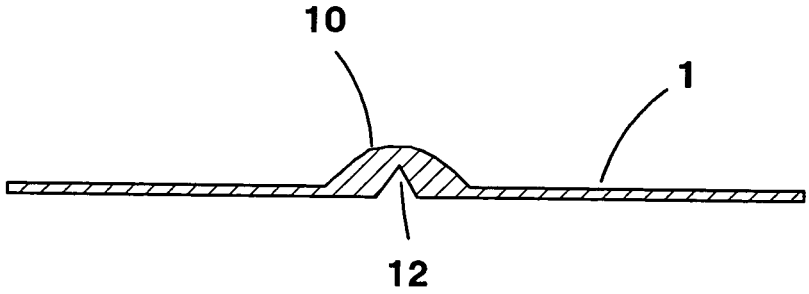
FIG. 7 shows a bull-nose embodiment of the present invention.

FIG. 7 shows an embodiment similar to that of FIGS. 4A, 5 and 6 with a bull-nose 10. While no extended flanges are shown in FIG. 7, this embodiment may also have extended flanges 16 similar to those shown in FIG. 5.

Several descriptions, examples and illustrations have been presented to better aid in understanding the present invention. One skilled in the art will realize that many changes and variations are possible without departing from the spirit of the invention. Each of these changes and variations is within the scope of the present invention.

I claim:

1. A method for allowing a standard mud dispensing box to tool both sides of a corner while the mud is still wet comprising the steps of:

providing a corner bead with a pair of elongated flanges, each of said flanges containing a recessed area outward of a protruding nose;

applying wet drywall mud to each of said two flanges while said mud is wet on both of said flanges;

allowing said drywall mud to dry on both flanges simultaneously;

sanding and finishing dried mud on both of said flanges.

2. The method of claim 1 wherein said flanges are plastic.

3. The method of claim 1 wherein said flanges have an outer paper covering layer.

4. The method of claim 3 wherein said outer paper covering layer extends outward beyond said flanges.

* * * * *